US007574882B2

(12) United States Patent
Uliano

(10) Patent No.: US 7,574,882 B2
(45) Date of Patent: Aug. 18, 2009

(54) TUBULAR RADIAL PIN TUMBLER LOCK

(76) Inventor: George Uliano, 6025 Cinderlane Pkwy., Orlando, FL (US) 32810

( * ) Notice: Subject to any disclaimer, the term of this patent is extended or adjusted under 35 U.S.C. 154(b) by 5 days.

(21) Appl. No.: 11/591,697

(22) Filed: Nov. 2, 2006

(65) Prior Publication Data

US 2008/0105016 A1 May 8, 2008

(51) Int. Cl.
*E05B 19/02* (2006.01)
*E05B 27/08* (2006.01)

(52) U.S. Cl. ..... 70/491; 70/417; 70/404

(58) Field of Classification Search ..... 70/491, 70/496, 417, 419, 403, 404
See application file for complete search history.

(56) References Cited

U.S. PATENT DOCUMENTS

| | | | | | |
|---|---|---|---|---|---|
| 1,978,781 | A | * | 10/1934 | Berger | 70/89 |
| 3,512,382 | A | | 5/1970 | Mathias et al. | |
| 3,524,335 | A | * | 8/1970 | George | 70/491 |
| 3,648,492 | A | * | 3/1972 | Walters et al. | 70/491 |
| 3,916,657 | A | | 11/1975 | Steinbach | |
| 4,069,696 | A | | 1/1978 | Steinbach | |
| 4,148,201 | A | | 4/1979 | Miyamae et al. | |
| 4,611,104 | A | * | 9/1986 | Reddy | 200/43.08 |
| 4,770,014 | A | * | 9/1988 | Knauer | 70/358 |
| 4,878,367 | A | * | 11/1989 | Bisbing | 70/491 |
| 4,899,565 | A | | 2/1990 | Steinbach | |
| 4,951,484 | A | * | 8/1990 | Rohald et al. | 70/59 |
| 5,020,349 | A | * | 6/1991 | Lee | 70/491 |
| 5,097,686 | A | * | 3/1992 | Plumer | 70/232 |
| 5,105,637 | A | * | 4/1992 | Kovens | 70/491 |
| 5,245,143 | A | * | 9/1993 | James et al. | 200/43.08 |
| 5,349,835 | A | * | 9/1994 | Liao | 70/491 |
| 6,957,556 | B1 | * | 10/2005 | Ha | 70/491 |
| 7,150,168 | B1 | * | 12/2006 | Kuo | 70/491 |
| 7,234,330 | B2 | * | 6/2007 | Tseng | 70/491 |
| 2002/0108406 | A1 | * | 8/2002 | Makos et al. | 70/16 |
| 2006/0117816 | A1 | * | 6/2006 | Lee | 70/58 |

FOREIGN PATENT DOCUMENTS

| | | |
|---|---|---|
| EP | 0936330 | 8/1999 |

* cited by examiner

*Primary Examiner*—Lloyd A Gall
(74) *Attorney, Agent, or Firm*—Ariel S. Bentolila; Bay Area IP, LLC

(57) ABSTRACT

A tubular radial pin tumbler lock is described. The radial pin tumbler lock has an outer shell, an inner shell housed in the outer shell, and a spindle housed in the inner shell. The spindle has a spindle head with an uneven number of irregular sides. A plurality of radial locking pins are arranged radially from the spindle. A crown on the spindle encases the locking pins. An anti-drill feature is included on the spindle head. An annular space between the inner shell and the spindle head allows access to the radial locking pins for operating the radial pin tumbler lock.

16 Claims, 5 Drawing Sheets

TUBULAR RADIAL PIN TUMBLER LOCK

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to locks. More particularly, the invention relates to a split pin tubular pin tumbler lock with an irregularly shaped and sided spindle heads, an anti-drill dimple or ball, and a crown on the spindle to protect the pins.

BACKGROUND OF THE INVENTION

A weakness of conventional tubular radial pin tumbler locks is poor key control because of a limited number of keyways available for the locks. Providing a variety of keyways enables a specific key to open a lock where other keys will not open that lock. Most keys for tubular radial pin tumbler locks are round on both the outside and the inside. The number of keyways available for a round key is limited to one. Therefore, any round key may be used to open any round tubular radial pin tumbler lock of the same size. And since a large number of these locks are the same size, the same key may be used to open many locks.

Another problem with conventional tubular radial pin tumbler locks in that these locks are prone to picking or being drilled into in order to open the lock. Various types of split pin tubular pin tumbler locks have been designed with varying attempts to make the lock more pick resistant and drill resistant. Examples of previous attempts to solve these problems include a specifically designed key that fits into a corresponding shell. Another example of prior art demonstrates how a certain key can be designed to only fit into a corresponding shell. These solutions do not address the picking problems with picking tools that fit over a round spindle, in the above previous solutions the changes were made to the outside diameter of the key which mates to the corresponding change to the shell. No changes were made to the spindle which remained round and subject to picking tools that fit over a round spindle. Others have tried to solve the problem to lock picking by using a different shaped key that would match up with the inner part of the lock. However, these solutions provide regularly shaped keys such as, but not limited to an octagon, which does not provide additional keyways since all of the sides are equal. Other have tried to solve picking problems by using multiple keys to operate the lock. However, the use of multiple keys can be inconvenient for users. Yet others have tried by using various methods, attempting to solve the picking and drilling problems with varying degrees of success. However, no prior art provides substantial drill protection.

In view of the foregoing, there is a need for an improved tubular radial pin tumbler lock and key that provides a larger number of keyways for increased key control and more protection against picking and drilling.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
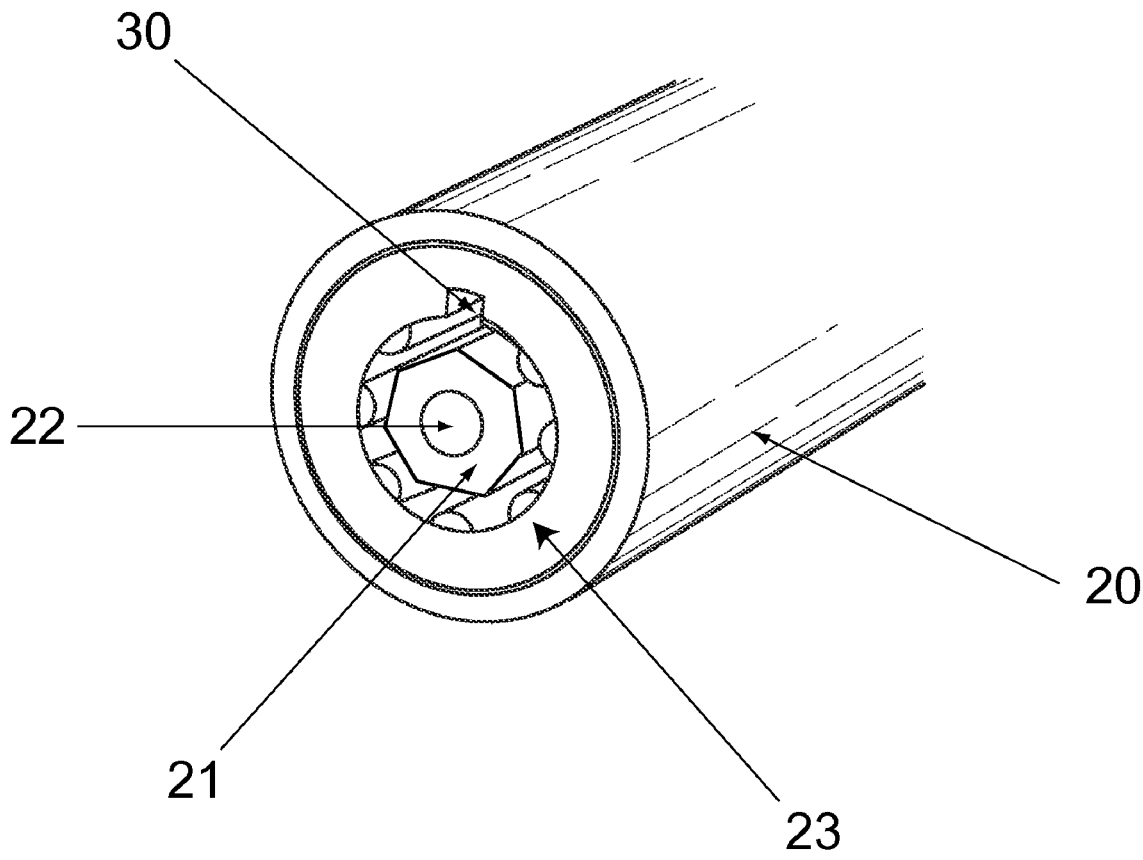
FIG. 1 is a perspective view of an exemplary tubular radial pin tumbler lock, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, a variety of implementations of tubular radial pin tumbler locks are described.

In one embodiment of the present invention, a radial pin tumbler lock having an outer shell, an inner shell housed in the outer shell, a spindle housed in the inner shell, the spindle having a spindle head, the spindle head having an uneven number of irregular sides, a plurality of radial locking pins arranged radially from the spindle, and an annular space between the inner shell and the spindle head, the annular space having dimensions allowing access to the radial locking pins for operating the radial pin tumbler lock is described.

In another embodiment, a radial pin tumbler locking apparatus having an outer shell, an inner shell housed in the outer shell, a spindle housed in the inner shell, the spindle having, a spindle head, the spindle head having an uneven number of irregular sides, a plurality of radial locking pins arranged radially from the spindle, a tubular key, the tubular key having a inner shape matching the spindle head, and an annular space between the inner shell and the spindle head, the annular space having dimensions allowing access to the radial locking pins by the tubular key for operating the radial pin tumbler lock is shown.

In yet another embodiment of the present invention, a radial pin tumbler locking apparatus having a means for receiving a tubular key having an uneven number of irregular surfaces interior to the tubular key and parallel to an axis of the tubular key, a means for encasing locking pins arranged to engage the tubular key when the tubular key is received, and a means for preventing drilling on an axis of the receiving means is described.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciate that those skilled in the art will, in light of the teachings of the present invention, recognized a multiplicity of alternate and suitable approaches, depending upon the needs of the particular application, to implement the functionality of any given detail described herein, beyond the particular implementation choices in the following embodiments described and shown. That is there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

The preferred embodiment of the present invention adds protection to a tubular radial pin lock by incorporating three design elements; an irregular shaped and sided spindle head, an anti-drill dimple or ball, and a crown on the spindle to protect locking pins. By combining these three elements, the key control of the lock is increased along with the drill resistance and the pick resistance of the lock.

FIG. 1 is a perspective view of an exemplary tubular radial pin tumbler lock, in accordance with an embodiment of the present invention. An outer shell 20 holds an inner shell 23 and a spindle 21. In the present embodiment, spindle 21 comprises a spindle head with an uneven number of irregular sides. The present embodiment has seven sides; however, any irregular and uneven number of sides may be used. The uneven sides of spindle 21 correspond with a key, shown by way of example in FIG. 5. By moving the uneven sides of spindle 21 to different positions on the circumference of spindle 21, a new keyway may be created.

A keyway is created when the sides of spindle 21 and the internal sides of the key match up so that the key fits over spindle 21. Other radial pin tumbler locks use a cylindrical spindle and key or an even number of sides for the spindle and key. However with the use of an uneven number of sides, as in the present embodiment, one of the sides is shorter or longer than the other sides and multiple keyways are created instead of only one keyway as created by locks with even sided on cylindrical spindles. For example, without limitation, if the uneven side of spindle 21 is at the one or two o'clock position, the uneven side must also be at the one to two o'clock position on the key in order for the key to fit over spindle 21 and operate the lock. Also, a key with an uneven side at the six to seven o'clock position cannot fit over spindle 21 in the present example. This key only fits over a spindle where the uneven side is at the six to seven o'clock position.

Anti-drill dimple or ball 22 is centered in spindle 21. Anti-drill dimple or ball 22 generally prevents any attempt to drill through the center of the lock, by preventing the drill bit to center itself in the center of spindle 21. If a drill attempt is made on a lock according to the present embodiment, the drill bit will slip or slide off of anti-drill dimple or ball 22. Anti-drill dimple or ball 22 is added to spindle 21 during the molding process of spindle 21.

Figure 2:
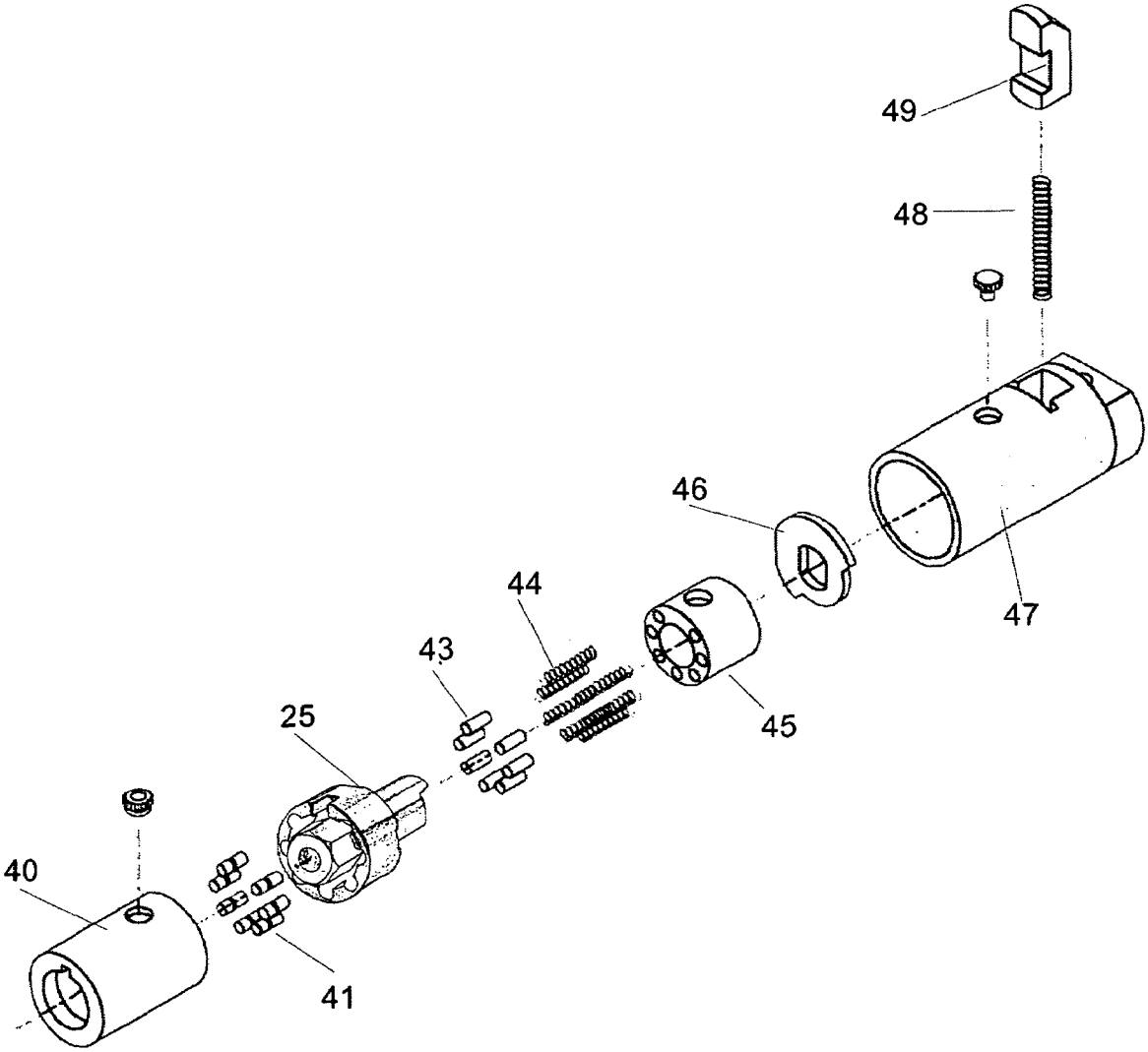
FIG. 2 shows a full exploded view of an exemplary tubular radial tumbler lock showing the relative position of all component parts, including, but not limited to, an outer shell, an inner shell and a spindle, in accordance with an embodiment of the present invention.

FIG. 2 shows a full exploded view of an exemplary tubular radial tumbler lock showing the relative position of all component parts, including, but not limited to, an outer shell 47, an inner shell 40 and a spindle 25, in accordance with an embodiment of the present invention. In at least one aspect, spindle 25 differs from prior art spindles in that the crown as been added to protect the pins and to reduce the possibility of picking. The addition of the anti-drill dimple or ball prevents drilling and the irregular shaped spindle head provides the ability to have multiple keyways in many practical applications.

In the present embodiment, spindle 25 is inserted into inner shell 40 and then both spindle 25 and inner shell 40 are inserted into out shell 47. A locking bolt 49, combination pins 41, a spindle 25, bottom pins 43, bottom pin springs 44, a lock bottom 45, a cam stop 46, and a locking bolt spring 48 are shown by way of example for reference and position. The cut key is inserted into inner shell 40 and over spindle head 25. The Combination pins 41 have different lengths (e.g., 0 to 7). There are 7 combination pins 41 in the present example. The matching key has seven cuts that match pins 41. When the key is inserted into this mechanism it pushes combination pins 41 against bottom pin springs 44. If the cuts on the inserted key matches the corresponding lengths of combination pins 41, a "shear line" will be created between the spindle 25 and the lock bottom 45. When this "shear line" is created the lock will turn and open. If the inserted key does not match the length of the combination pins 41, at least one of combination pins 41 extend through the bottom of spindle 25 into lock bottom 45 the lock will not turn.

Figure 3:
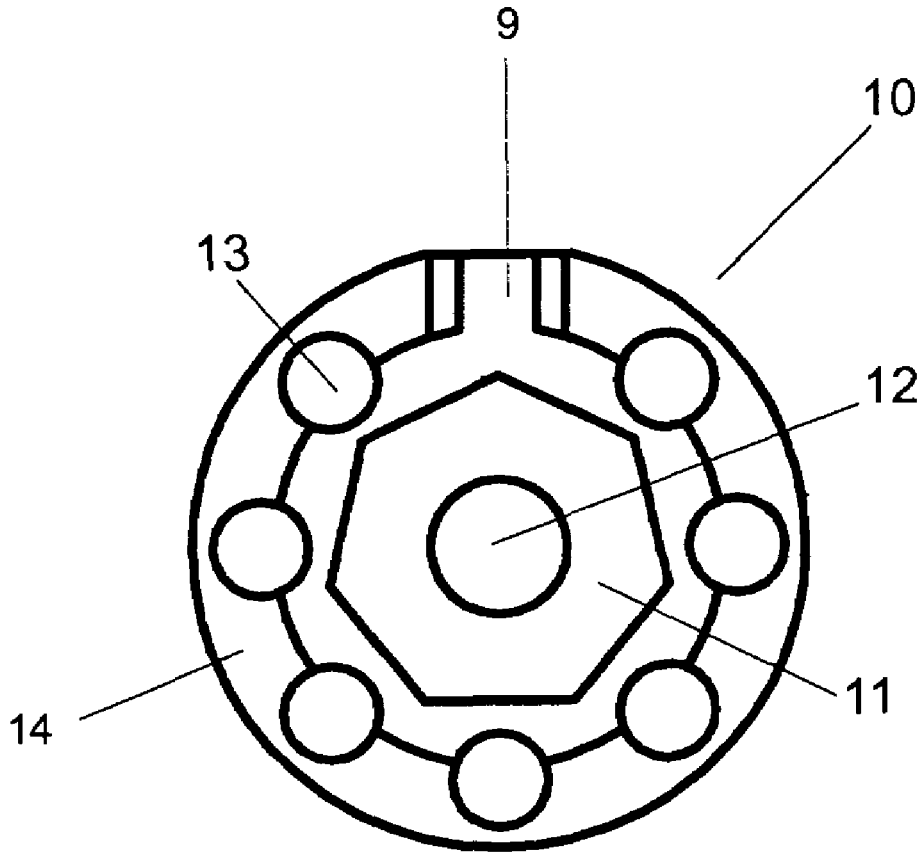
FIG. 3 shows a frontal view of an exemplary tubular radial lock, showing an inner shell and a spindle, in accordance with an embodiment of the present invention.

FIG. 3 shows a frontal view of an exemplary tubular radial lock, showing a spindle 10, in accordance with an embodiment of the present invention. A seven sided spindle head 11 and an anti-drill dimple or ball 12 are shown for reference. Locking pin holes 13 are shown for reference as to the location of a crown 14 on spindle 10. Crown 14 encases locking pins on all sides of spindle 10 except for the position where the key engages the locking pins. This prohibits the locking pins from pushing outward if a picking attempt is made on the lock with either a picking tool or another foreign object.

Figure 4:
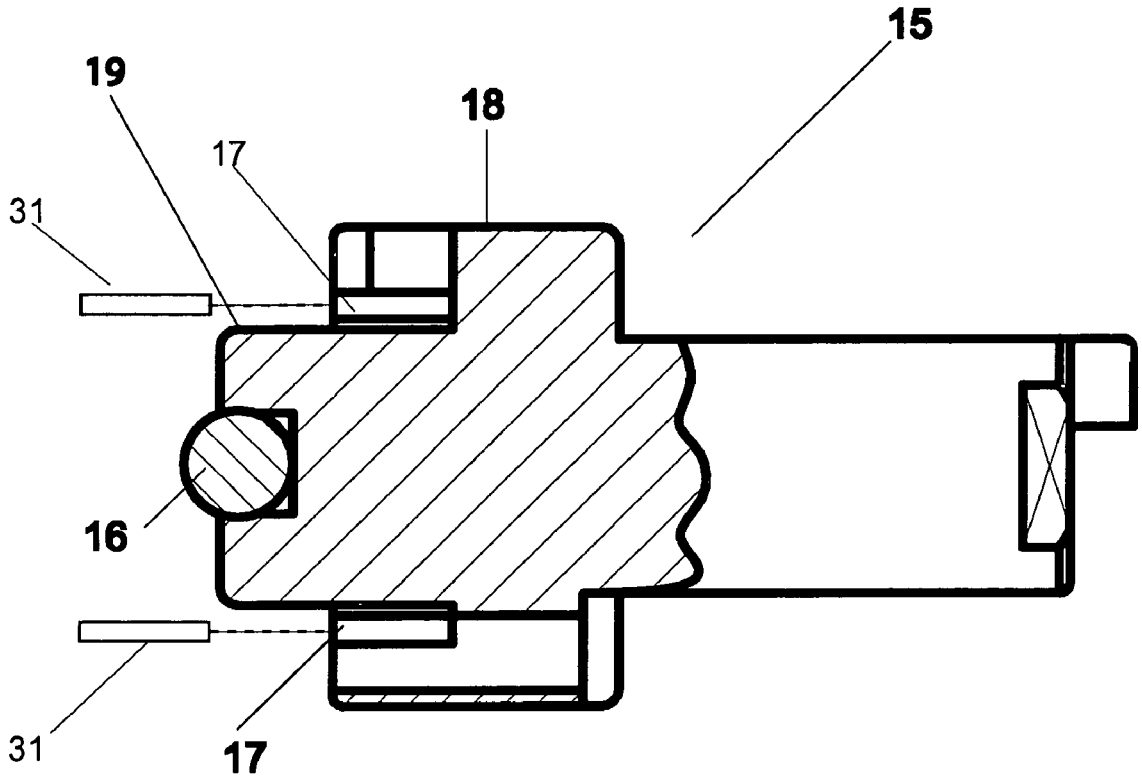
FIG. 4 shows a cross-sectional view of an exemplary spindle in accordance with an embodiment of the present invention.

FIG. 4 shows a cross-sectional view of an exemplary spindle 15, in accordance with an embodiment of the present invention. The present embodiment comprises an anti-drill dimple or ball 16 positioned in a spindle head 19. A spindle crown 18 protects the lock pins by providing a pin enclosure 17. Spindle crown 18 is an improvement over current spindle designs because spindle crown 18 completely encloses the pins in pin enclosure 17. The design of spindle crown 18 increases the anti-picking qualities of the lock by preventing the pins from being pushed out toward the outer shell, shown by way of example in FIG. 2.

Figure 5:
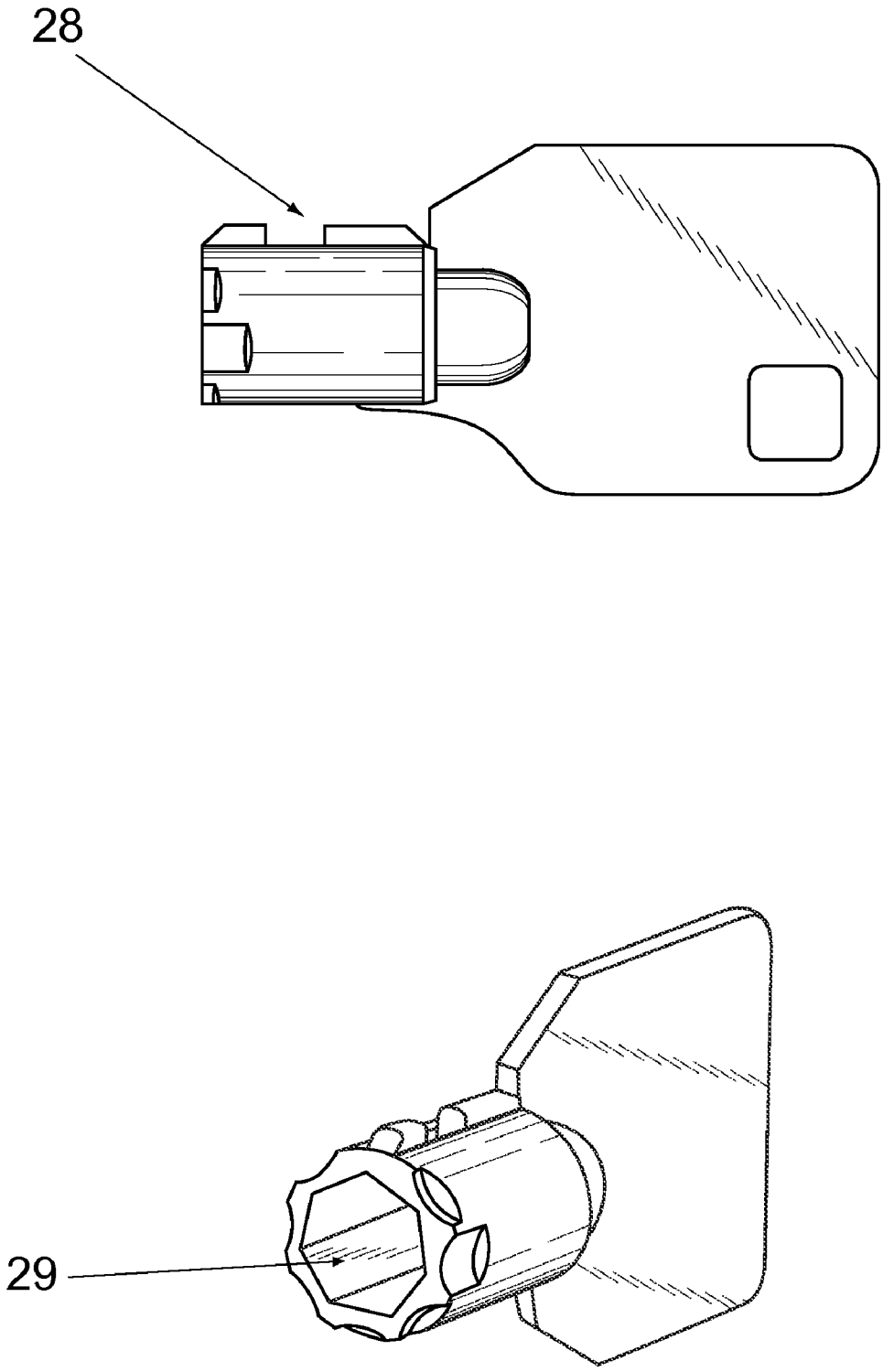
FIG. 5 shows a side view and a frontal view of an exemplary key showing seven sides of the interior of the key, in accordance with an embodiment of the present invention.

FIG. 5 shows a side view and frontal view of an exemplary key 28 showing an inner shape 29 of key 28, in accordance with an embodiment of the present invention. In the present embodiment inner shape 29 has seven uneven sides. Key 28 is made to mate with a spindle, shown by way of example in FIG. 1, 2, 3, and 4, so that the uneven or shorter side of inner shape 29 is in the same position on key 28 and the spindle. The outer surface of key 28 is a smooth cylinder, and the open end of key 28 is not chamfered. In alternate embodiments, the outer surface of key 28 may be a different shape providing the shape matches up with the lock corresponding with key 28. In the present embodiment, key 28 is metal. However, key 28 may be made of various alternate embodiments including, without limitation, hard plastic.

By adding uneven sides on the spindle and the key, an anti-drill dimple or ball and a crown to the spindle, tubular radial pin tumbler locks according to the preferred embodiment of the present invention are more protective than current tubular radial pin locks. The present embodiment is incorporated in a plug lock, however, in alternate embodiments this same design may be incorporated into most any tubular radial pin locks such as, but not limited to, cam locks, desk locks, vending locks, and padlocks.

All of our ideas are implemented on the spindle with the corresponding irregular sides on the key. Our spindle with irregular sides, anti-drill dimple or ball and crown can be made to a smaller diameter size to solve the same problems we have shown here, but effective on the smaller diameter sized tubular radial pin tumbler locks. The same applies with the key it can also be made smaller to match up with the smaller sized diameter spindle and lock, thereby creating additional keyways for the smaller sized tubular radial pin tubular locks.

In our current embodiment, our locks are made from a die cast steel material, however, other material such as rigid plastic, stainless steel, brass or other metals and or plastics may be used.

Having fully described at least one embodiment of the present invention, other equivalent or alternative means for implementing a tubular radial pin tumbler lock according to the present invention will be apparent to those skilled in the art. The invention has been described above by way of illustration, and the specific embodiments disclosed are not intended to limit the invention to the particular forms disclosed. The invention is thus to cover all modifications, equivalents, and alternatives falling within the spirit and scope of the following claims.

What is claimed is:

1. A radial pin tumbler lock comprising:

an outer shell;

an inner shell housed in said outer shell;

a spindle housed in said inner shell, said spindle comprised of a spindle head, a spindle crown and a portion extending from said spindle crown for engaging a lock bolt, said spindle head comprising an uneven number of irregular sides, said spindle crown comprising an uneven number of pin enclosures comprising an axial depth, where a plurality of positions of said uneven number of irregular sides relative to said spindle crown defines a plurality of keyways;

an uneven number of radial locking pins comprising combination pins of a plurality of different axial lengths and bottom pins, said radial locking pins arranged radially from said spindle head in said pin enclosures where said inner shell substantially constrains said radial locking pins from moving in a direction radially to an axis of rotation of said spindle; and an annular space between said inner shell, said spindle head and an inner surface of said spindle crown, said annular space having dimensions allowing access to said radial locking pins where each of said radial locking pins is required to be depressed within said pin enclosures a distance substantially equal to said axial depth minus said axial length of said respective radial locking pin for operating the radial pin tumbler lock.

2. The radial pin tumbler lock as recited in claim 1, wherein said radial locking pins are constrained from moving in a direction radially outward from said spindle.

3. The radial pin tumbler lock as recited in claim 1, wherein one of said dimensions of said annular space defines a smooth cylindrical surface.

4. The radial pin tumbler lock as recited in claim 1, wherein said spindle head further comprising an anti-drill feature located axially of said spindle.

5. The radial pin tumbler lock as recited in claim 4, wherein said anti-drill feature is a ball.

6. The radial pin tumbler lock as recited in claim 4, wherein said anti-drill feature is a dimple.

7. The radial pin tumbler lock as recited in claim 1, wherein one of said irregular sides is shorter than the other sides.

8. A radial pin tumbler locking apparatus comprising:

an outer shell;

an inner shell housed in said outer shell;

a spindle housed in said inner shell, said spindle comprised of a spindle head, a spindle crown and a portion extending from said spindle crown for engaging a lock bolt, said spindle head comprising an uneven number of irregular sides, said spindle crown comprising an uneven number of pin enclosures comprising an axial depth, where a plurality of positions of said uneven number of irregular sides relative to said spindle crown defines a plurality of keyways;

an uneven number of radial locking pins comprising combination pins of a plurality of different axial lengths and bottom pins, said radial locking pins arranged radially from said spindle head in said pin enclosures where said inner shell substantially constrains said radial locking pins from protruding from said crown and said crown substantially constrains said radial locking pins from moving in a direction radially to an axis of rotation of said spindle;

a tubular key, said tubular key comprising a inner shape matching said spindle head, where an uneven number of irregular sides of said inner shape are positioned to match a keyway defined by said spindle head and said spindle crown, and an uneven number of axial cuts on a bottom of a tubular surface of said tubular key, said axial cuts comprising axial dimensions corresponding to said plurality of different lengths of said combination pins; and an annular space between said inner shell, said spindle head and an inner surface of said spindle crown, said annular space having dimensions allowing access to said radial locking pins by said tubular key where each of said radial locking pins is depressed within said pin enclosures a distance substantially equal to said axial depth minus said axial length of the respective combination pin for operating the radial pin tumbler locking apparatus.

9. The radial pin tumbler locking apparatus as recited in claim 8, wherein said radial locking pins are constrained from moving in a direction radially outward from said spindle.

10. The radial pin tumbler locking apparatus as recited in claim 8, wherein said spindle head further comprising an anti-drill feature located axially of said spindle.

11. The radial pin tumbler locking apparatus as recited in claim 10, wherein said anti-drill feature is a ball.

12. The radial pin tumbler locking apparatus as recited in claim 10, wherein said anti-drill feature is a dimple.

13. The radial pin tumbler locking apparatus as recited in claim 8, wherein said tubular key comprises a smooth cylindrical surface.

14. The radial pin tumbler locking apparatus as recited in claim 8, wherein one of said irregular sides is shorter than the other sides.

15. A radial pin tumbler locking apparatus comprising:

a spindle comprised of:

means for receiving a tubular key having an uneven number of irregular surfaces interior to said tubular key and an uneven number of axial cuts of varying lengths exterior to said tubular key and parallel to an axis of said tubular key where a plurality of positions of said receiving means defines a plurality of keyways;

means for constraining radial locking pins in at least one axial direction and radially to said receiving means where said radial locking pins are arranged to engage said axial cuts of said tubular key when said tubular key is received and the radial pin tumbler locking apparatus is operated;

means for engaging a lock bolt; and means for preventing drilling on an axis of said receiving means.

16. The radial pin tumbler locking apparatus as recited in claim 15, further comprising means for housing said spindle.

* * * * *